United States Patent [19]

Jaeger

[11] Patent Number: 4,743,017

[45] Date of Patent: May 10, 1988

[54] DUMBBELL ATTACHMENT

[76] Inventor: Marvin J. Jaeger, 502½ E. Atlantic St., Appleton, Wis. 54911

[21] Appl. No.: 767,527

[22] Filed: Aug. 20, 1985

[51] Int. Cl.[4] ..... A63B 11/00

[52] U.S. Cl. ..... 272/122; 272/143

[58] Field of Search ..... 272/68, 122, 123, 127, 272/143, 93, 117; 294/137, 145, 148, 159, 165, 166

[56] References Cited

U.S. PATENT DOCUMENTS

| | | | |
|---|---|---|---|
| D. 230,752 | 3/1974 | Speyer | D34/5 K |
| 734,062 | 7/1903 | Harris | 272/122 |
| 1,672,944 | 6/1928 | Jowett | 272/122 |
| 1,779,594 | 10/1930 | Hall | 272/123 |
| 1,917,566 | 7/1933 | Wood | 272/122 |
| 2,114,790 | 4/1938 | Venables | 272/122 X |
| 2,214,052 | 9/1940 | Good | 272/122 X |
| 2,655,300 | 10/1953 | Willms | 294/165 |
| 3,635,382 | 1/1972 | Wilson | 294/166 |
| 3,771,785 | 11/1973 | Speyer | 272/123 |
| 3,825,253 | 7/1974 | Speyer | 272/123 |
| 3,913,908 | 10/1975 | Speyer | 272/123 |
| 4,029,312 | 6/1977 | Wright | 272/123 |
| 4,076,236 | 2/1978 | Ionel | 272/123 |
| 4,331,357 | 5/1982 | Contreras | 294/165 X |
| 4,484,740 | 11/1984 | Green | 272/122 X |
| 4,531,728 | 7/1985 | Wright | 272/143 X |
| 4,607,840 | 8/1986 | Harper | 272/122 X |

OTHER PUBLICATIONS

Advertisement for "Super Shoulder Pads" in the Sporting Goods Dealer, Aug./1983.

"How to Use Heavyhands", Heavyhands Instruction Manuel, pp. 4 and 5, AMF Inc., 1982.

"Kettlebell Handles", *York Barbells and Fitness Training Equipment,* York Barbell Company.

*Primary Examiner*—Richard J. Apley

*Assistant Examiner*—Robert W. Bahr

*Attorney, Agent, or Firm*—Andrus, Sceales, Starke & Sawall

[57] ABSTRACT

Weight lifting apparatus is provided by a dumbbell (2) having a pair of outer weights (4 and 6) connected by a central bar (8) extending therebetween, and an auxiliary add-on weight member (10) having a central handle (12) extending between outer legs (14 and 16) removably attached to the bar (8) and extending transversely to the bar (8) adjacent the inside facing surfaces (22 and 24) of the outer weights (4 and 6). The outer legs (14 and 16) are releasably attached to the central bar (8) by clips (18 and 20) providing easy attachment with a push-on motion in a direction transverse to the bar (8), and easy release with a pull-off motion in a direction transverse to the bar (8).

21 Claims, 2 Drawing Sheets

DUMBBELL ATTACHMENT

BACKGROUND AND SUMMARY

The invention relates to weight lifting apparatus, and particularly to a dumbbell attachment system.

The invention provides a weight lifting system for reducing equipment requirements by eliminating the number of dedicated lifting weight dumbbells in a set. Instead, intermediate lifting weights are enabled by an auxiliary weight member removably attached to the next lower weight dumbbell. The auxiliary weight member is removably attachable to each of the different lifting weight dumbbells in the set and reduces the number of dumbbells required by more than half, by adding only the single additional auxiliary weight member.

The invention features a particularly simple and effective design and construction of the auxiliary weight member. In one aspect of the invention, the auxiliary weight member has a central handle extending between a pair of outer legs which in turn extend transversely to the central bar adjacent the inside facing surfaces of the outer weights of the dumbbell. In a further aspect of the invention, releasable clip means on each of the legs provides easy attachment to the bar with a push-on motion in a direction transverse to the bar, and easy release of the legs from the bar with a simple pull-off motion in a direction transverse to the bar.

DETAILED DESCRIPTION

Figure 1:
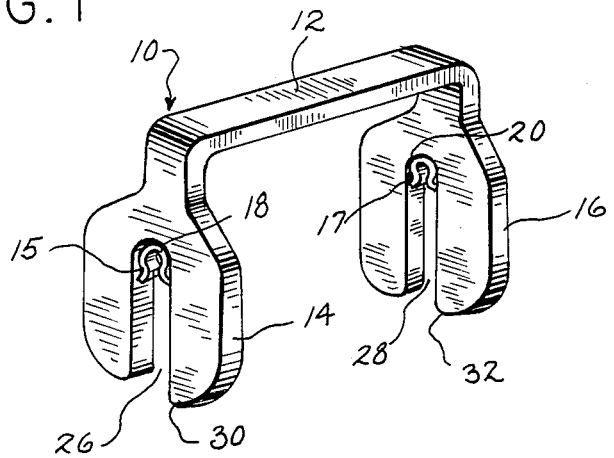
FIG. 1 is a isometric view of a dumbell attachment auxiliary weight member in accordance with the invention.
Figure 2:
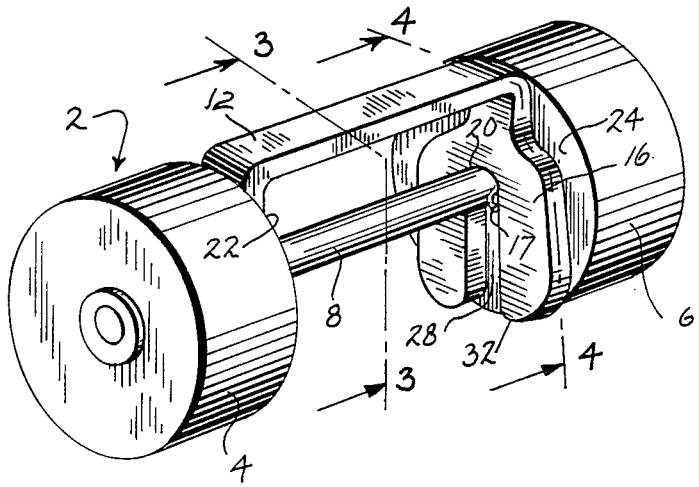
FIG. 2 is an isometric view of weight lifting apparatus in accordance with the invention, including the auxiliary add-on weight member.

There is shown in FIGS. 1 and 2 weight lifting apparatus including a dumbbell 2 having a pair of outer weights 4 and 6 connected by a central bar 8 extending therebetween. An auxiliary weight member 10 is shown in isolation in FIG. 1, and is shown attached to bar 8 in FIG. 2. Auxiliary weight member 10 is a generally U-shaped member having a central handle or bight 12 extending between a pair of outer legs or end portions 14 and 16. Attachment means 18 and 20 on legs 14 and 16 removably attach such legs to bar 8. Outer legs 14 and 16 extend transversely to bar 8 adjacent the inside facing surfaces 22 and 24 of outer weights 4 and 6.

Attachment means 18, 20 comprises releasable clip or grip means on each of outer legs 14 and 16 for attaching the legs to bar 8 with a push-on motion in a direction transverse to bar 8, and for releasing legs 14 and 16 from bar 8 with a pull-off motion in a direction transverse to the bar. Outer legs 14 and 16 have respective slots 26 and 28 formed therein from respective outer tips 30 and 32 of the legs and then extending toward handle 12, upwardly as viewed in FIGS. 1–3, along the noted direction of push-on pull-off motion. Clips 18 and 20 are secured in respective slots 26 and 28 at the upper ends thereof toward handle 12.

Figure 3:
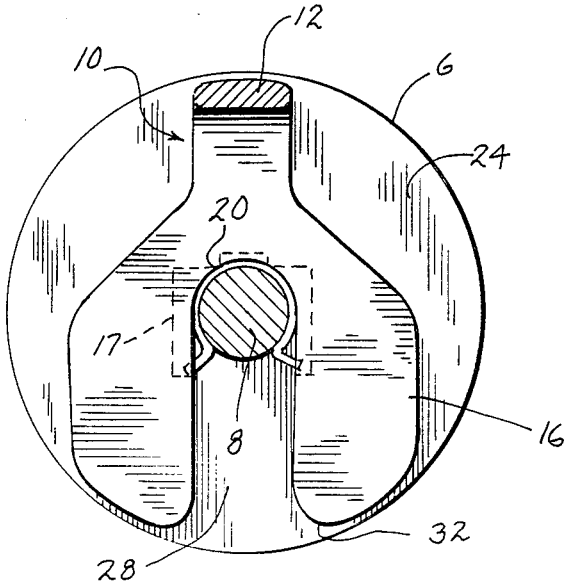
FIG. 3 is a sectional view taken along line 3—3 of FIG. 2.
Figure 4:
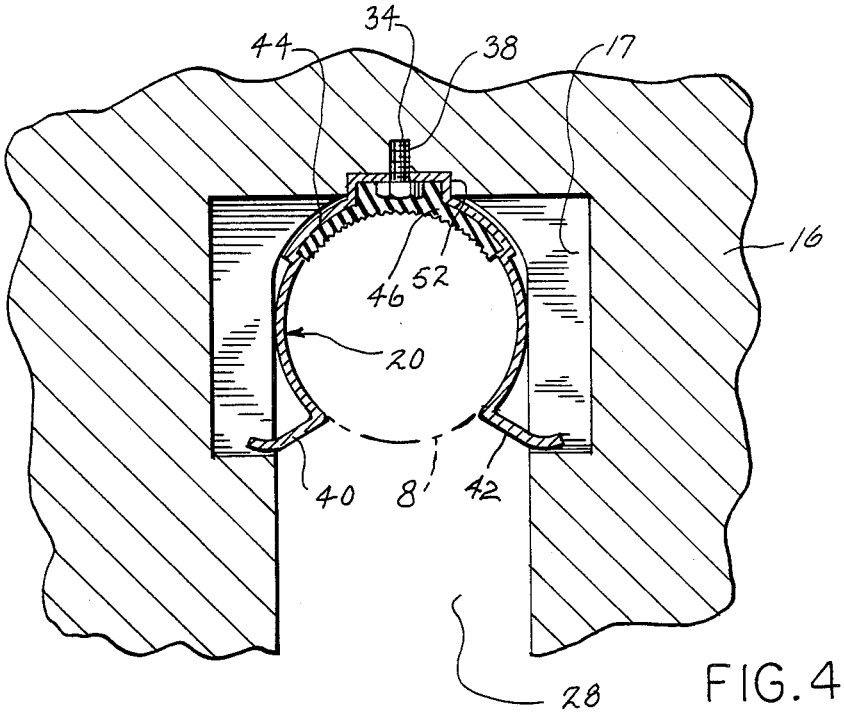
FIG. 4 is an enlarged view of a portion of FIG. 3.
Figure 5:
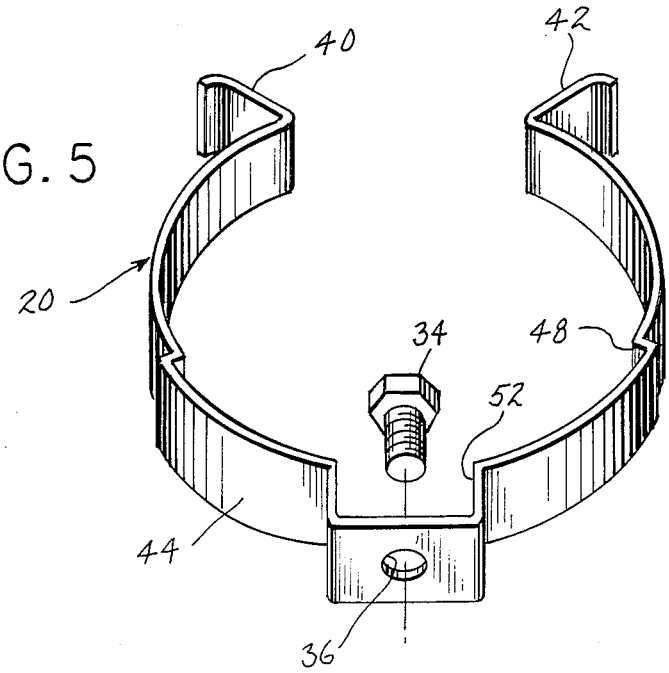
FIG. 5 is an isometric view of the clip of FIG. 4.
Figure 6:
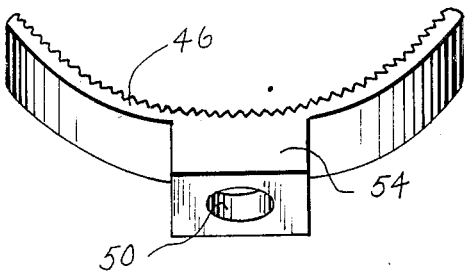
FIG. 6 is an isometric view of the rubber grip pad of FIG. 4.

Referring to FIGS. 3–5, each clip 20 is a resilient spring grip member mounted to leg 16 by a screw 34 extending through aperture 36 and into a threaded bore 38 in leg 16. Clip 20 has a pair of resilient jaws 40 and 42 separating and moving away from each other during push-on attachment motion with bar 8 sliding transversely therebetween, upwardly as seen in FIG. 4, and then moving towards each other to grip bar 8, and then separating again during pull-off detachment releasing motion as bar 8 slides transversely therebetween, downwardly as shown in FIG. 4. Each leg 14 and 16 has a respective recess or cavity 15 and 17 formed therein at the upper end of respective slots 26 and 28 to allow clearance therein for outward flexing of clip jaws 40 and 42.

Clip 20 has at least a partially circular configuration, preferably with a gap between jaws 40 and 42, and has a central base portion 44 between the jaws and fixedly secured to leg 16 at screw 34. A rubber pad 46 is disposed along base portion 44 between base portion 44 and bar 8 for gripping the bar and providing a further tight grip of the clip on the bar to prevent movement. Base portion 44 has a recessed section at 48 opposite from and recessed away from jaws 40 and 42. Rubber pad 46 is disposed in recessed section 48 and includes an aperture 50 through which screw 34 extends. Base portion 44 includes a further recess at 52, through which aperture 36 extends, for further locating and retaining rubber pad 46 at stepped boss 54 and providing a thicker stock section and support around mounting screw 34 extending therethrough. Rubber pad 46 is secured to clip 20 by glue, or by a friction fit or the like.

In accordance with the invention, a weight lifting system and method is provided for reducing equipment requirements. A set of dumbbells is provided, and auxiliary weight member 10 is removably attachable to the central bar 8 of each of the dumbbells, and includes a central handle portion 12 extending between a pair of outer legs 14 and 16 removably attached to bar 8 adjacent outer weights 4 and 6 of each dumbbell. The dumbbells are provided at a plurality of different lifting weights. Intermediate lifting weights are provided by adding the removable auxiliary weight member 10 to any of the dumbbells, whereby to enable provision of an intermediate lifting weight without a dedicated dumbbell therefor. This reduces the number of dumbbells in the set by more than half by adding only the single additional auxiliary weight member removably attachable to each of the dumbbells.

In one particular embodiment of the weight lifting system in accordance with the invention, a prior set of 11 dumbbells increasing in weight from 5 pounds to 55 pounds is replaced by a set of 5 dumbbells. The prior set of dumbbells increased in weight at 5 pound increments. In accordance with the present invention, only the 10 pound, 20 pound, 30 pound, 40 pound and 50 pound dumbbells are used. The add-on auxiliary weight member is provided at a 5 pound lifting weight. The initial 5 pound lift is provided by the auxiliary add-on weight member itself. A 10 pound lift is provided by the 10 pound dumbbell. A 15 pound lift is provided by the 10 pound dumbbell with the auxiliary weight member attached thereto. A 20 pound lift is provided by the 20 pound dumbbell. A 25 pound lift is provided by the 20 pound dumbbell with the auxiliary weight member attached thereto, and so on up to a 55 pound lift provided by the 50 pound dumbbell with the 5 pound auxiliary weight member attached thereto. The invention thus affords a full lifting range from 5 to 55 pounds with only 5 dumbbells and the single auxiliary add-on weight member 10, instead of the 11 dumbbells in the prior system.

Further in the above example and in accordance with the invention, 2.5 and 7.5 pound auxiliary add-on weight members may also be used in addition to the 5 pound auxiliary add-on weight member. The same set of dumbbells can thus increase in 2.5 pound increments instead of 5 pound increments. In this particular embodiment, the invention thus affords a full lifting range from 2.5 to 57.5 pounds with the same 5 dumbbells. The set of 5 dumbbells together with the 3 auxiliary add-on weight members is thus equivalent to a set of 23 dumbbells, and offers more than twice the weight variance of the prior 11 dumbbell set, all without additional dumbbells.

It is recognized that various alternatives and modifications are possible within the scope of the appended claims.

I claim:

1. For a dumbbell having a pair of outer weights connected by a bar extending therebetween, the improvement comprising:

an auxiliary weight member having sufficient weight for use in weight lifting exercises, said auxiliary weight member comprising a pair of end portions and a central portion extending between said end portions, said central portion being laterally offset from the center of said end portions; and attachment means for removably attaching said auxiliary weight member to said dumbbell and for retaining said auxiliary weight member on said dumbbell without simultaneous gripping of said central portion and said bar by the user, wherein said central portion of said auxiliary member is spaced from said bar when said auxiliary weight member is attached to said dumbbell.

2. The invention according to claim 1 wherein said auxiliary weight member comprises a generally U-shaped member having a central bight extending between a pair of outer legs, wherein said outer legs extend transversely to said bar adjacent the inside facing surfaces of said outer weights.

3. The invention according to claim 1 wherein said attachment means comprises clip means disposed on the end portions of said auxiliary weight member, for removably attaching said end portions to said bar of said dumbbell.

4. For a dumbbell having a pair of outer weights connected by a bar extending therebetween, the improvement comprising:

an auxiliary weight member for attachment to said dumbbell, said auxiliary weight member having sufficient weight for use in weight lifting exercises and comprising a pair of outer legs and a central handle extending between said outer legs; and attachment means for removably attaching said auxiliary weight member at an auxiliary weight member point of attachment to said bar with a push-on motion in a direction transverse to said bar, and for releasing said auxiliary weight member from said bar with a pull-off motion in a direction transverse to said bar, said central handle being laterally offset from said auxiliary weight member point of attachment to said bar.

5. The invention according to claim 4 wherein said attachment means comprises clip means disposed on each of said outer legs, for removably attaching said outer legs to said bar of said dumbbell.

6. The invention according to claim 5 wherein each of said outer legs has a slot formed therein from an outer tip of said leg and extending toward said handle along said direction of push-on pull-off motion, and wherein said clip means is secured in said slot at the end thereof toward said handle.

7. The invention according to claim 5 wherein said clip means comprises a resilient spring grip member mounted to its respective said leg and having a pair of resilient jaws moving away from each other during said push-on motion with said bar sliding transversely therebetween and then moving towards each other to grip said bar, and then moving away from each other again during said pull-off motion.

8. The invention according to claim 7 wherein said spring grip member has at least a partially circular configuration with a central base portion between said jaws, said central base portion being fixedly secured to said leg, and comprising a rubber pad along said base portion between said base portion and said bar for gripping said bar and providing a further tight grip of said clip means on said bar.

9. The invention according to claim 8 wherein said base portion of said spring grip member has a recessed section opposite from and recessed away from said jaws, and wherein said rubber grip is disposed in said recessed section.

10. For a dumbbell having a pair of outer weights connected by a bar extending therebetween, an auxiliary weight member comprising a pair of outer legs and a a handle extending between said pair of outer legs, said legs being removably attachable to said bar, and attachment means for removably attaching said auxiliary weight member to said bar with a push-on motion in a direction transverse to said bar, and for releasing said auxiliary weight member from said bar with a pull-off motion in a direction transverse to said bar, wherein said central handle of said auxiliary weight member is spaced from said bar, and wherein said attachment means comprises clip means disposed on each of said outer legs for removably attaching said outer legs to said bar of said dumbbell and wherein each of said outer legs has a slot formed therein from an outer tip of said leg and extending towards said handle along said direction of push-on pull-off motion, and wherein said clip means comprises a resilient spring grip member mounted to its respective said leg in said slot at the end thereof toward said handle, each said leg having a cavity formed therein at the upper end of its respective said slot, said resilient spring grip member of said clip means having a pair of resilient jaws moving away from each other during said push-on motion with said bar sliding transversely therebetween and then moving towards each other to grip said bar, and then moving away from each other again during said pull-off motion, said cavity in said end of said slot toward said handle allowing clearance therein for outward flexing of said jaws away from each other.

11. Weight lifting apparatus comprising:

a dumbbell having a pair of outer weights connected by a central bar;

an auxiliary weight member having sufficient weight for use in weight lifting exercises, comprising a pair of end portions and a central portion extending between said end portions, said central portion being laterally offset from the center of said end portions; and attachment means for removably attaching said auxiliary weight member to said dumbbell and for retaining said auxiliary weight member on said dumbbell without simultaneous gripping of said central portion and said bar by the user, wherein said central portion of said auxiliary weight member is spaced from said bar when said auxiliary weight member is attached to said dumbbell.

12. The invention according to claim 11 wherein said auxiliary weight member comprises a generally U-shaped member having a central bight extending between a pair of outer legs, and wherein said outer legs extend transversely to said bar adjacent the inside facing surfaces of said outer weights.

13. Weight lifting apparatus for reducing equipment requirements, comprising:

a set of differently weighted dumbbells each having a pair of outer weights connected by a bar extending therebetween;

an auxiliary weight member having sufficient weight for use in weight lifting exercises and removably attachable to said bar of each of said dumbbells, said auxiliary weight member comprising a pair of outer legs and a central handle portion extending between said pair of outer legs, said central handle portion being laterally offset from the point of attachment of said auxiliary weight member to said bar;

attachment means for removably attaching said auxiliary weight member to said dumbbell and for retaining said auxiliary weight member on said dumbbell without simultaneous gripping of said central handle portion and said bar by the user, and wherein said central handle portion is spaced from said bar when said auxiliary weight member is attached to said dumbbell;

whereby intermediate lifting weights are provided by adding said removable auxiliary weight member to any of said dumbbells to enable provision of said intermediate lifting weight without a dedicated dumbbell therefor, thereby reducing the number of dumbbells in said set by more than half by adding only the single additional said auxiliary weight member removably attachable to each of said dumbbells.

14. The invention according to claim 13 wherein said outer legs of said auxiliary weight member extend transversely to said bar adjacent the inside facing surfaces of said outer weights of said dumbbell.

15. Weight lifting apparatus for reducing equipment requirements, comprising:

a set of differently weighted dumbbells each having a pair of outer weights connected by a bar extending therebetween;

an auxiliary weight member removably attachable to said bar of each of said dumbbells, said auxiliary weight member comprising a pair of outer legs and central handle portion extending between said pair of outer legs, said central handle portion being laterally offset from the center of said outer legs;

attachment means for removably attaching said auxiliary weight member to said dumbbell wherein said central handle portion is spaced from said bar, and wherein said attachment means retains said auxiliary weight member on said dumbbell without simultaneous gripping of said central portion and said bar by the user;

whereby intermediate lifting weights are provided by adding said removable auxiliary weight member to any of said dumbbells to enable provision of said intermediate lifting weight without a dedicated dumbbell therefore, thereby reducing the number of dumbbells in said set by more than half by adding only the single additional said auxiliary weight member removably attachable to each of said dumbbells; and one or more auxiliary weight members in addition to said first mentioned auxiliary weight member and of a different weight therefrom to provide further incremental intermediate lifting weights, each said extra auxiliary weight member being removably attachable to said dumbbells and comprising a central handle portion extending between a pair of outer legs removably attachable to said dumbbell adjacent said outer weights.

16. Weight lifting apparatus comprising:

a dumbbell having a pair of outer weights connected by a central bar;

an auxiliary weight member comprising end portions and a central portion extending between said end portions, said central portion being laterally offset from the center of said end portions;

attachment means comprising clip means disposed on the end portions of said auxiliary weight member, for removably attaching said end portions to said bar of said dumbbell, wherein said central portion of said auxiliary weight member is spaced from said bar, and wherein said attachment means retains said auxiliary weight member on said dumbbell without simultaneous gripping of said central portion and said bar by the user.

17. The invention according to claim 16 wherein said auxiliary weight member comprises a central handle extending between a pair of outer legs, and comprising releasable clip means on each of said legs for attaching said legs to said bar with a push-on motion in a direction transverse to said bar, and for releasing said legs from said bar with a pull-off motion in a direction transverse to said bar.

18. Weight lifting apparatus for reducing equipment requirements, comprising:

a set of differently weighted dumbbells each having a pair of outer weights connected by a bar extending therebetween;

an auxiliary weight member removably attachable to said bar of each of said dumbbells, said auxiliary weight member comprising a pair of outer legs and a central handle portion extending between said pair of outer legs, said central handle portion being laterally offset from the center of said outer legs;

attachment means comprising clip means disposed on each of said outer legs for removably attaching said outer legs of said bar to said dumbbells, wherein said central handle portion is spaced from said bar, and wherein said attachment means retains said auxiliary weight member on said dumbbell without simultaneous gripping of said central portion and said bar by the user;

whereby intermediate lifting weights are provided by adding said removable auxiliary weight member to any of said dumbbells to enable provision of said intermediate lifting weight without a dedicated dumbbell therefore, thereby reducing the number of dumbbells in said set by more than half by adding only the single additional said auxiliary weight member removably attachable to each of said dumbbells.

19. The invention according to claim 18 comprising releasable clip means on each of said legs and attaching said legs to said bar for each of said dumbbells with a push-on motion in a direction transverse to said bar, and releasing said legs from said bar with a pull-off motion in a direction transverse to said bar.

20. For a dumbbell having a pair of outer weights connected by a bar extending therebetween, the improvement comprising an auxiliary weight member having sufficient weight for use in weight lifting exercises, said auxiliary weight member adapted for releasable attachment to said bar, and resilient releasable attachment means being mounted to said auxiliary weight member for releasably attaching said auxiliary weight member to said bar, said attachment means being disposed in a slot provided in said auxiliary weight member extending from an outer tip of said auxiliary weight member toward the center of said auxiliary weight member and forming a pocket adapted to receive said bar, said attachment means resiliently retaining said auxiliary weight member on said bar without being gripped by the user and providing quick manual releasable attachment and removal of said auxiliary weight member to and from said bar.

21. The invention according to claim 20 wherein said releasable attachment means comprises clip means mounted to said auxiliary weight member for attaching said auxiliary weight member to said bar with a push-on motion in a direction transverse to said bar, and for releasing said auxiliary weight member from said bar with a pull-off motion in a direction transverse to said bar, said clip means being secured in said pocket adapted to receive said bar.

* * * * *